US009300073B2

(12) United States Patent
Ju

(10) Patent No.: US 9,300,073 B2
(45) Date of Patent: Mar. 29, 2016

(54) ELECTRICAL CONNECTOR HAVING A FIXING PIECE ATTACHED TO A CONDUCTING TERMINAL

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/575,804

(22) Filed: Dec. 18, 2014

(65) Prior Publication Data

US 2015/0207259 A1 Jul. 23, 2015

(30) Foreign Application Priority Data

Jan. 22, 2014 (CN) ..... 2014 2 0039459 U

(51) Int. Cl.
*H01R 13/514* (2006.01)
*H01R 13/434* (2006.01)

(52) U.S. Cl.
CPC ..... *H01R 13/434* (2013.01)

(58) Field of Classification Search
CPC ... H01R 13/426; H01R 13/434; H01R 13/424
USPC ..... 439/752, 745, 741, 739, 733.1, 66
See application file for complete search history.

(56) References Cited

U.S. PATENT DOCUMENTS 4,932,899 A * 6/1990 Sueyoshi ..... H01R 13/4365 439/594
8,624,428 B2 * 1/2014 Hurst ..... B60L 3/0069 307/10.1
8,678,866 B2 * 3/2014 Hiraishi ..... H01R 13/4365 439/595
2005/0095923 A1 * 5/2005 Mase ..... H01R 43/26 439/752

* cited by examiner

*Primary Examiner* — Chandrika Prasad
(74) *Attorney, Agent, or Firm* — Locke Lord LLP; Tim Tingkang Xia, Esq.

(57) ABSTRACT

An electrical connector used for electrically connecting a first electronic element and a second electronic element opposite to each other, includes an insulating body and multiple conducting terminals. The insulating body has multiple receiving spaces, and the conducting terminals are correspondingly accommodated in the receiving spaces. At least one fixing piece is connected to one of the conducting terminals through at least one insulation piece, and the fixing piece fixes the conducting terminal to the corresponding receiving space.

20 Claims, 9 Drawing Sheets

100

100

ELECTRICAL CONNECTOR HAVING A FIXING PIECE ATTACHED TO A CONDUCTING TERMINAL

CROSS-REFERENCE TO RELATED APPLICATION

This non-provisional application claims priority under 35 U.S.C. §119(a) on Patent Application No. 201420039459.8 filed in P.R. China on Jan. 22, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and particularly to an electrical connector having good high-frequency performance.

BACKGROUND OF THE INVENTION

With rapid development of electronic technologies, people impose increasingly high requirements on the signal transmission rate and the high-frequency performance of an electronic product. Currently, as functions of electronic products are increasingly high-end oriented and complicated, structure design of a terminal is increasingly complex. Generally, a terminal has a main body portion used for transmitting an electric signal, and at least one fixing piece protruding from the main body portion, where the fixing piece is used for cooperating with an insulating body so that the terminal is fixed in the insulating body. This structure makes the manufacturing procedure of the terminal simple. However, the main body portion of the terminal is protruded with the fixing piece to result in that the terminal differs in width and thickness, and width and thickness changes of the terminal may cause impedances of segments of the terminal to change, so when a high-frequency signal passes through a segment whose impedance changes, signal reflection may occur, thereby affecting signal integrity, and causing undesirable high-frequency performance.

Therefore, it is necessary to design an improved electrical connector, so as to overcome the foregoing problem.

SUMMARY OF THE INVENTION

In one aspect, the present invention is directed to an electrical connector that effectively reduces signal reflection and has good high-frequency effect.

In one embodiment, an electrical connector is used for electrically connecting a first electronic element and a second electronic element opposite to each other. The electrical connector includes an insulating body arranged with multiple receiving spaces, and conducting terminals fixed in the receiving spaces by fixing pieces.

In one embodiment, the conducting terminals are inclined in the receiving spaces.

In one embodiment, an inclination angle of the conducting terminals relative to the first electronic element is greater than 45 degrees and less than 80 degrees.

In one embodiment, the conducting terminals are essentially in a regular structure.

In one embodiment, the conducting terminals are essentially in a straight-plate structure.

In one embodiment, an angle exists between the fixing piece and the conducting terminals, and one of the conducting terminals partly overlaps with another fixing piece adjacent to the one conducting terminal from a front view.

In one embodiment, the fixing piece has a torsion arm connected to the conducting terminals by using the insulation piece. The torsion arm is provided with at least one positioning portion positioned with respect to the receiving spaces.

In one embodiment, each of the receiving spaces has a first inner wall. The first inner wall is provided with a limiting slot. A stopping block protrudes from a side of the limiting slot. The stopping block is located at a lower side or an upper side of the positioning portion. The stopping block and the positioning portion are not in close fit between each other so that the fixing piece may be slightly displaced in the limiting slot.

In one embodiment, there are two fixing pieces. The two fixing pieces are located at two opposite sides of the conducting terminals. The fixing pieces are separately limited at the limiting slots of the receiving spaces that are disposed opposite to each other.

In one embodiment, a convex portion extends from another side of the torsion arm relative to the positioning portion and is limited at the limiting slot.

In one embodiment, the receiving space further includes a second inner wall disposed opposite to the first inner wall. A convex rib is selectively disposed at the second inner wall or the conducting terminals. Correspondingly, the convex rib selectively urges against the conducting terminals or the second inner wall.

In one embodiment, the two fixing pieces are connected at a same height of the conducting terminals.

In one embodiment, the two fixing pieces are connected at different heights of the conducting terminals.

In one embodiment, the conducting terminals and the fixing piece are all made of a conducting material.

In one embodiment, the insulation piece is elastic.

In one embodiment, a surface of the insulation piece is coated with viscose gluing the conducting terminals and the fixing piece, or the insulation piece is made of viscose.

In one embodiment, the multiple receiving spaces located at a same row are in communication with each other.

In one embodiment, the fixing piece is made of an insulation material, and the fixing piece is elastic.

In one embodiment, the fixing piece and the insulation piece are integrally formed.

Compared with the related art, certain embodiments of the present invention, among other things, have the following beneficial advantages. The conducting terminals are connected to the fixing piece through the insulation piece. The fixing piece fixes the conducting terminals to the insulating body. That is, the conducting terminals and the fixing piece are in an insulation connection, and the fixing piece does not affect impedances of the conducting terminals. When a high-frequency signal is applied, high-frequency signal reflection due to an impedance change caused by the fixing piece is prevented, thereby ensuring good high-frequency signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
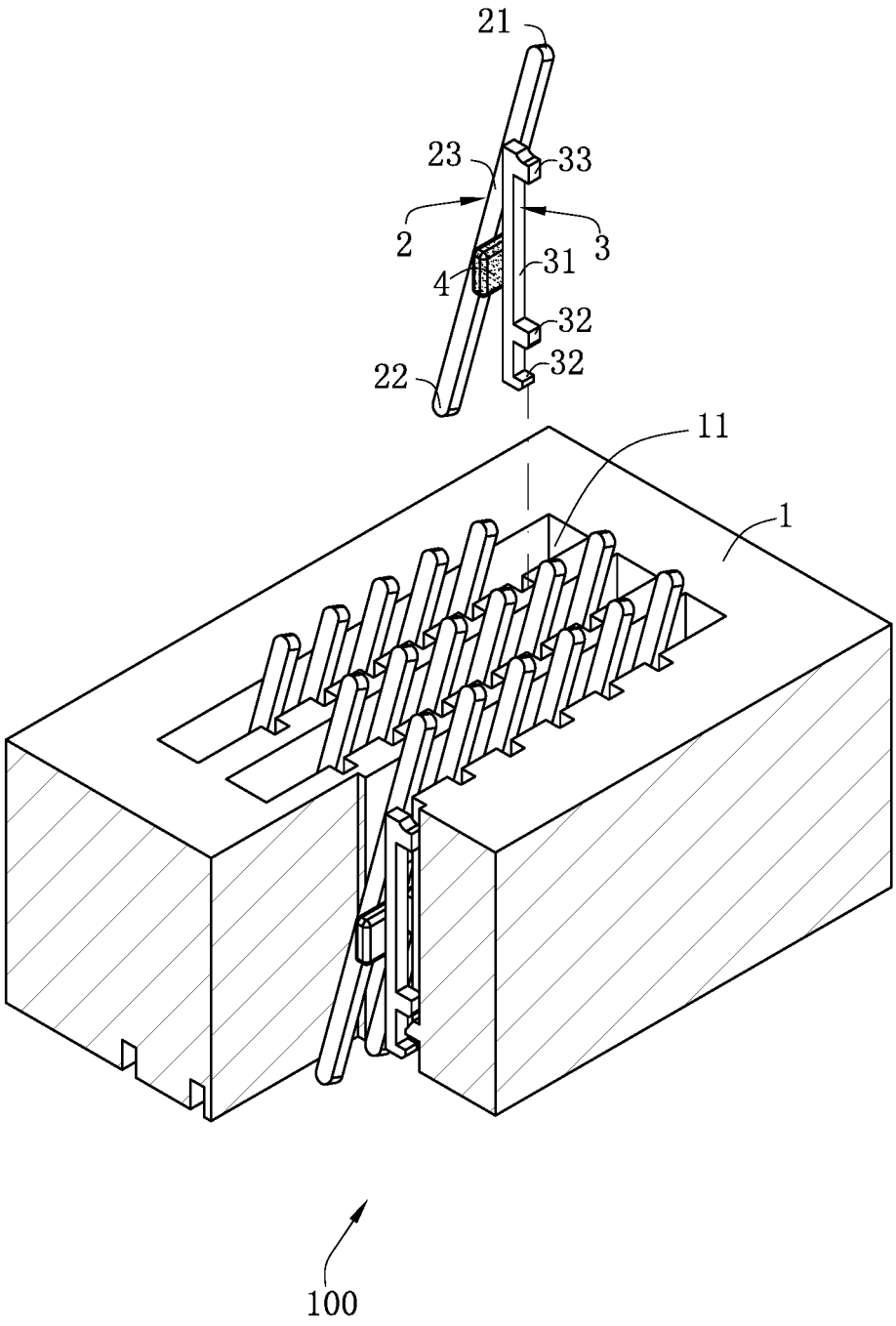
FIG. 1 is a schematic three-dimensional view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
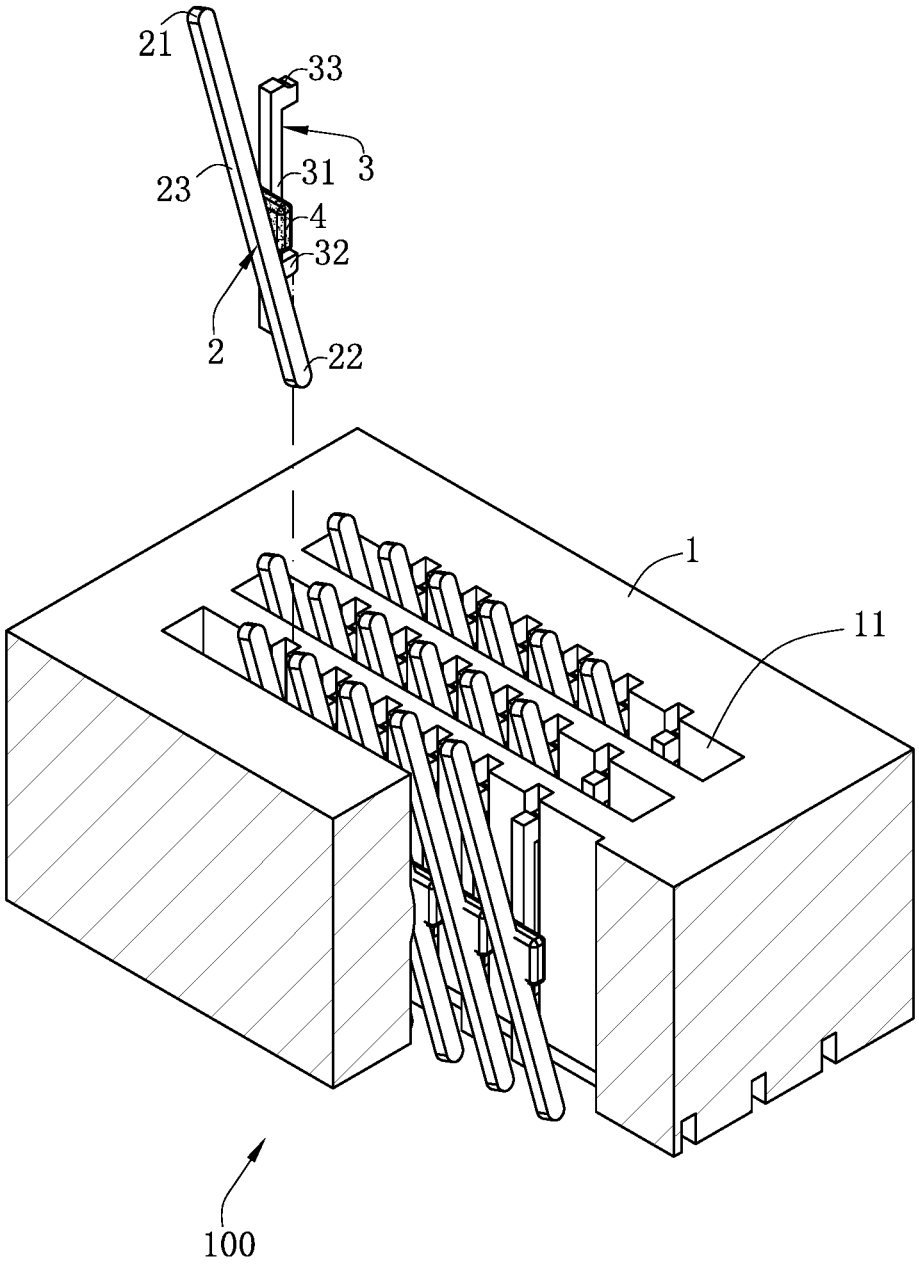
FIG. 2 is a schematic three-dimensional view of the electrical connector viewed from another angle.
Figure 4:
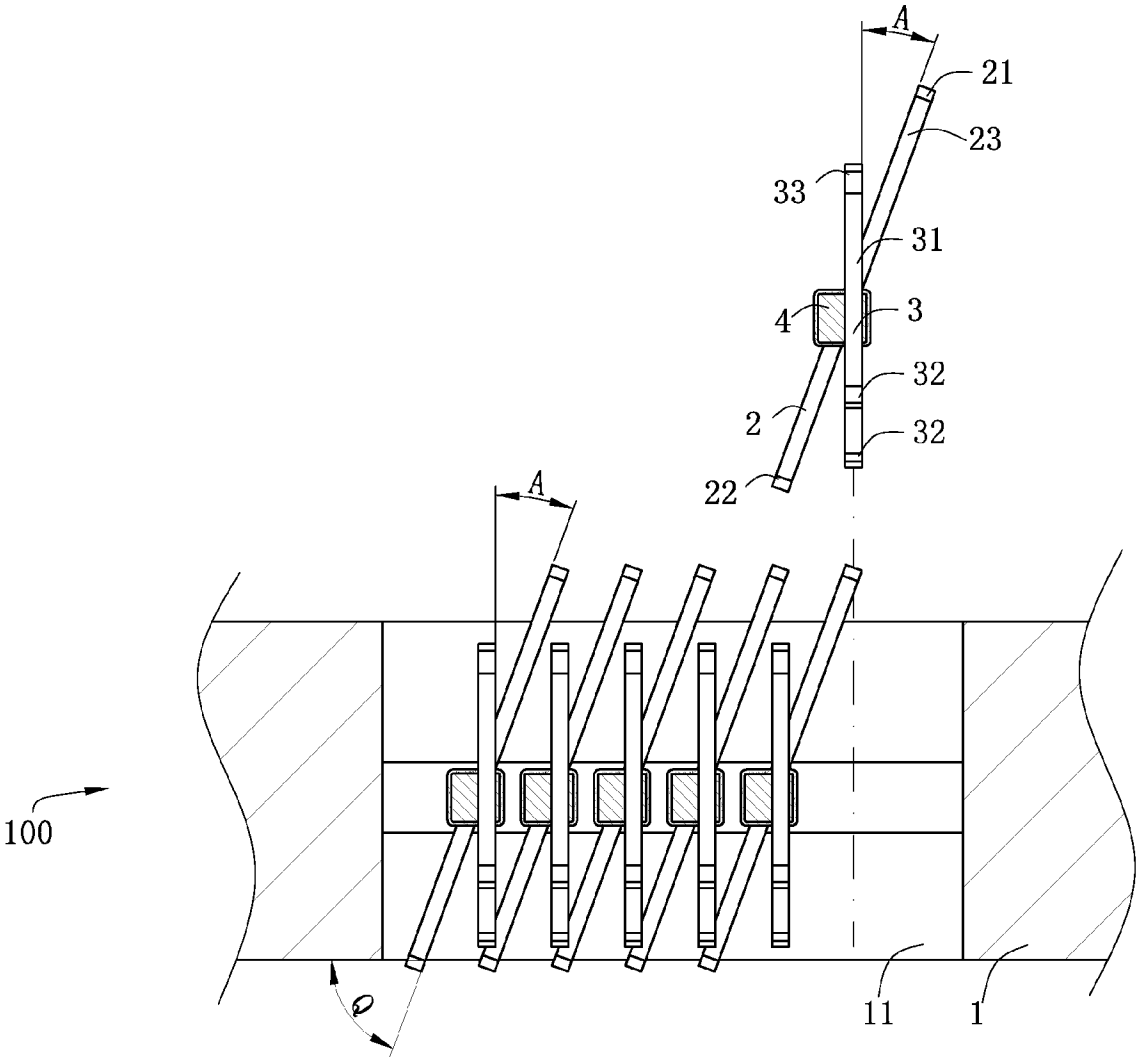
FIG. 4 is a schematic front view of the electrical connector shown in FIG. 1 and FIG. 2.

In a first embodiment, as shown in FIGS. 1, 2 and 4, an electrical connector 100 according to one embodiment of the present invention is used to electrically connect a first electronic element (not shown) and a second electronic element (not shown). The electrical connector 100 includes an insulating body 1, and multiple conducting terminals 2 and multiple fixing pieces 3 correspondingly accommodated in the insulating body 1. In this embodiment, the first electronic element is a chip module (not shown), and the second electronic element is a circuit board (not shown).

As shown in FIGS. 1, 2, 5 and 6, the insulating body 1 is arranged with multiple receiving spaces 11. The receiving spaces 11 run through the insulating body 1 from top to bottom, and the receiving spaces 11 located at a same row are in communication with each other. The receiving space 11 further has a first inner wall 111 and a second inner wall 112, and the first inner wall 111 and the second inner wall 112 are disposed opposite to each other. A limiting slot 1111 is disposed at the first inner wall 111, and runs through the insulating body 1 from top to bottom. A stopping block 1112 protrudes from a side of the limiting slot 1111 toward a direction in which the second inner wall 112 is located. Meanwhile, the second inner wall 112 is convexly provided with a convex rib 1121 toward a direction in which the first inner wall 111 is located.

Figure 3:
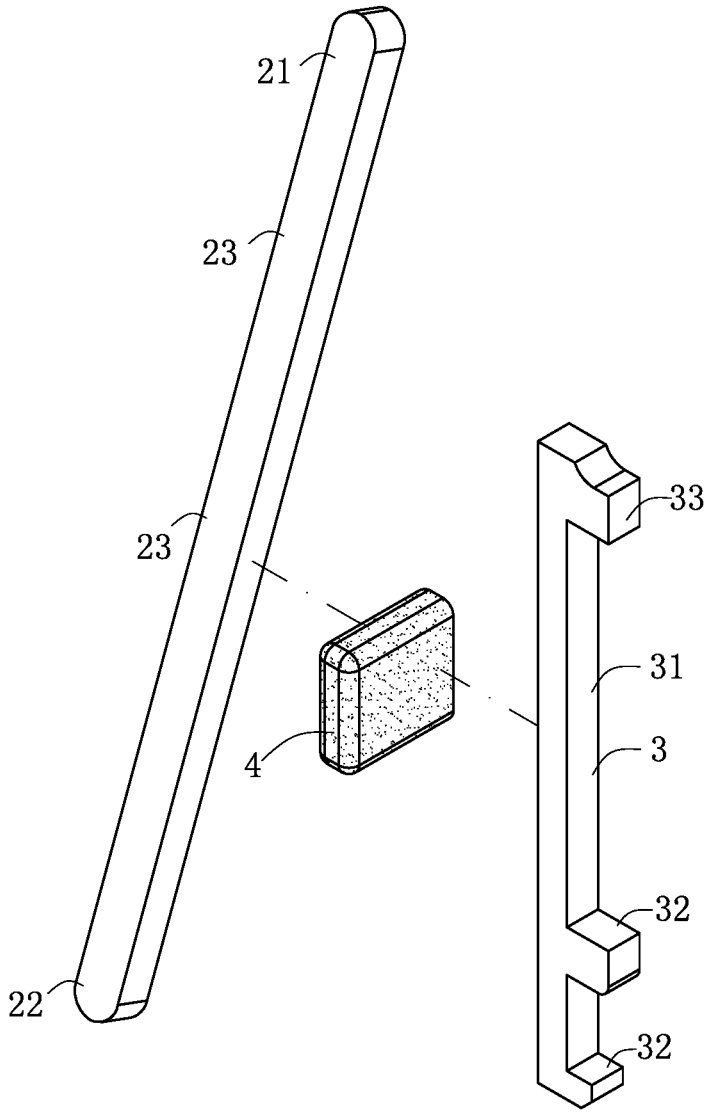
FIG. 3 is a schematic exploded view of a conducting terminal of the electrical connector according to one embodiment of the present invention.
Figure 5:
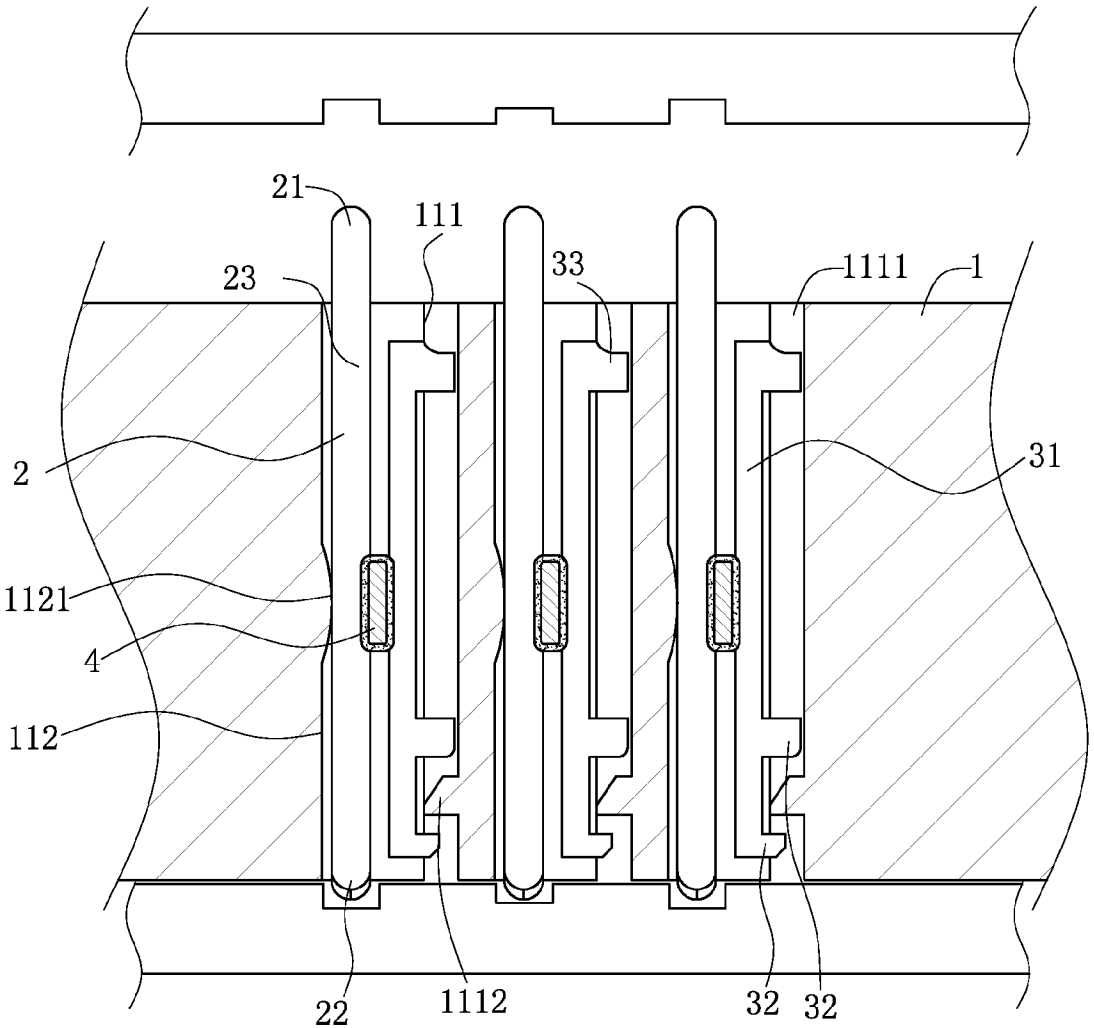
FIG. 5 is a schematic lateral sectional view of the electrical connector shown in FIG. 1 and FIG. 2.

As shown in FIGS. 3-6, the conducting terminal 2 has a main body portion 23 urging against the convex rib 1121. In other embodiments, the main body portion 23 may also be convexly provided with a convex rib 1121 toward a direction in which the second inner wall is located and the convex rib 1121 urges against the second inner wall 112. The second inner wall 112 urges against the main body portion 23 of the conducting terminal 2 through the convex rib 1121, which may alleviate the problem that when the conducting terminal 2 is pressed by an external force, electric performance is undesired in due to excessive swing in the left to right direction. The conducting terminal 2 extends upward from the main body portion 23 to have a first contact portion 21, and the first contact portion 21 is upward exposed out of the insulating body 1 to contact the chip module (not shown). In a situation in which the impedance change of the conducting terminal 2 is reduced as much as possible, and the first contact portion 21 can also very well cooperate with a contact point of the chip module (not shown), the cross sectional area of the first contact portion 21 is slightly less than the cross sectional area of the main body portion 23. The conducting terminal 2 extends downward from the main body portion 23 to have a second contact portion 22, and the second contact portion 22 is downward exposed out of the insulating body 1 to contact the circuit board (not shown). Same as the foregoing, in a situation in which the impedance change of the conducting terminal 2 is reduced as much as possible, and the second contact portion 22 can also very well cooperate with a contact point of the circuit board (not shown), the cross sectional area of the second contact portion 22 is slightly less than the cross sectional area of the main body portion 23. As shown in FIG. 4, the conducting terminal 2 is essentially in a regular structure and is inclined. The inclination angle Q of the longitudinal direction of the conducting terminals relative to the bottom surface of the chip module or the bottom surface of the circuit board or the bottom surface of the insulating body 1 is optimally greater than 45 degrees and less than 80 degrees. Further, the longitudinal direction of the conducting terminal 2 forms an angle A with the longitudinal direction of the fixing piece 3. In certain embodiments, the angle A is an acute angle. The regular structure includes a straight-plate shaped structure, as shown in FIG. 3 and FIG. 5, a straight-column shaped structure, a straight-cylinder structure and the like, but is not limited thereto.

As shown in FIGS. 3-6, the fixing piece 3 is connected to the main body portion 23 of the conducting terminal 2 through an insulation piece 4. The fixing piece 3 has a torsion arm 31. Two positioning portions 32 extend downward from a same side of the torsion arm 31, and are located at the upper side and the lower side of the stopping block 1112 respectively. The stopping block 1112 is limited between the two positioning portions 32 with a gap, to prevent the conducting terminal 2 from sliding off from the limiting slot 1111 under the action of an unmindful external force, and meanwhile to provide slight up and down displacement of the fixing piece 3 in the limiting slot 111. A convex portion 33 extends upward from the other side of the torsion arm 31 relative to the positioning portion 32, convexly stretches into the limiting slot 1111, and is limited by two opposite side walls in front of and behind the limiting slot 1111. The convex portion 33 is limited at the limiting slot 1111 in a direction from front to rear, and the conducting terminal 2 may be slightly swung in the direction from front to rear under the action of an external force. The fixing piece 3 and the conducting terminal 2 are each made of a conducting material. Alternatively, the conducting terminal 2 may be made of a conducting material, while the fixing piece 3 is made of another non-metal material, or the fixing piece 3 and the insulation piece 4 are integrally formed by a same material.

As shown in FIG. 4, one of the conducting terminals 2 partly overlaps with another fixing piece 3 adjacent to the one conducting terminal from the front view. As shown in FIG. 1 and FIG. 2, one of the conducting terminals 2 partly overlaps with another conducting terminal 2 adjacent to the one conducting terminal from the top view. In one embodiment, under the premise without causing a short-circuited situation, adjacent conducting terminals 2 are arranged as closely as possible between each other.

As shown in FIGS. 1-3, the insulation piece 4 is an elastic insulation rubber. The surface of the insulation piece 4 is coated with viscose, and by using the viscose, the insulation piece 4 glues the conducting terminal 2 and the fixing piece 3 together. Alternatively, in other embodiments, the insulation piece 4 itself may also be viscose (for example, red gum).

During assembly, at first, the fixing piece 3 is fixed to the conducting terminal 2 using the insulation piece 4. Then the assembled conducting terminal 2 is inserted into the receiving space 11 from the top of the receiving space 11, so that the convex portion 33 and the positioning portion 32 slide from top to bottom along the limiting slot 1111, until the two positioning portions 32 are positioned at the upper and lower sides of the stopping block 1112. In this case, the second inner wall 112 urges against the main body portion 23 through the convex rib 1121. Then the electrical connector 100 is placed at the circuit board (not shown), so that the circuit board (not shown) and the second contact portion 22 are in a pressing connection. Finally the chip module (not shown) is in a pressing connection with the top of the electrical connector 100 and in a pressing connection with the first contact portion 21.

Figure 6:
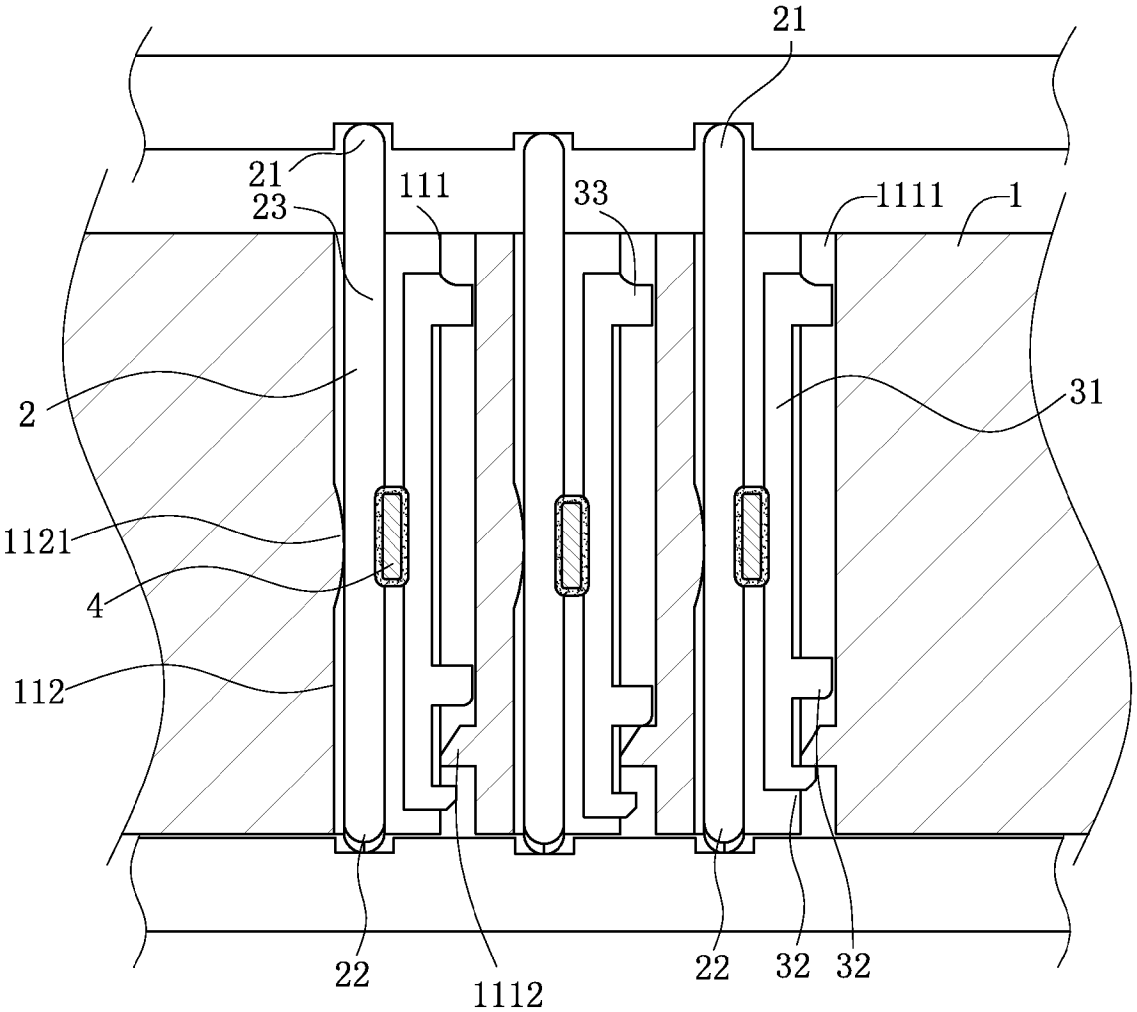
FIG. 6 is a schematic lateral sectional view in which the electrical connector shown in FIG. 5 is pressed, and a conducting terminal is displaced.

As shown in FIG. 5 and FIG. 6, when the conducting terminal 2 is pressed by the chip module (not shown) and the circuit board (not shown), under the action of a vertical component force, because the positioning portion 32 and the stopping block 1112 are in clearance fit, the fixing piece 3 is slightly displaced in a vertical direction, and the torsion arm 31 of the fixing piece 3 is also slightly and elastically contracted in the vertical direction, to result in that the conducting terminal 2 is slightly displaced in the vertical direction, and contact locations of first contact portions 21 of all of the conducting terminals 2 and the chip module (not shown) are located at a same horizontal plane, thereby ensuring good electric performance between the conducting terminals 2 and the chip module (not shown) and the circuit board (not shown), and avoiding a phenomenon of undesired contact which may be caused due to unevenness of contact points on the circuit board and the chip module. There are numerous conducting terminals 2, so contact surfaces between the multiple conducting terminals 2 and the chip module (not shown) and the circuit board (not shown) may be not absolutely horizontal. In this case, under the action of a horizontal component force, the torsion arm 31 of the fixing piece 3 is also slightly and elastically twisted in the horizontal direction, to result in that the conducting terminal 2 is correspondingly swung in the horizontal direction. The conducting terminal 2, under the action of an elastic restoring force generated due to torsion of the fixing piece 3, closely contacts the chip module (not shown) and the circuit board (not shown), thereby avoiding the phenomenon that the contact is undesired because a part of the conducting terminals 2 are subject to unbalanced forces.

Figure 7:
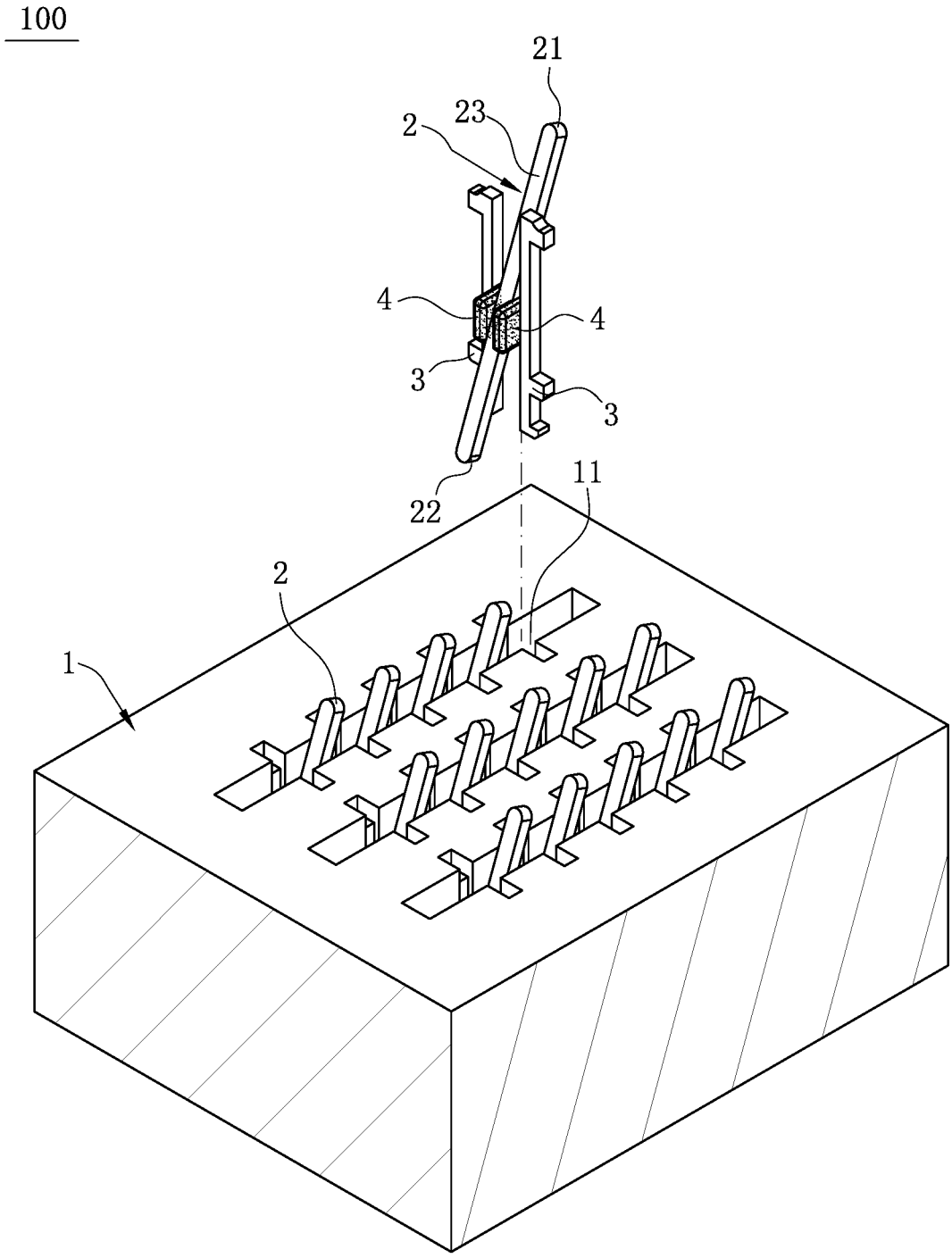
FIG. 7 is a schematic three-dimensional view of an electrical connector according to one embodiment of the present invention.
Figure 8:
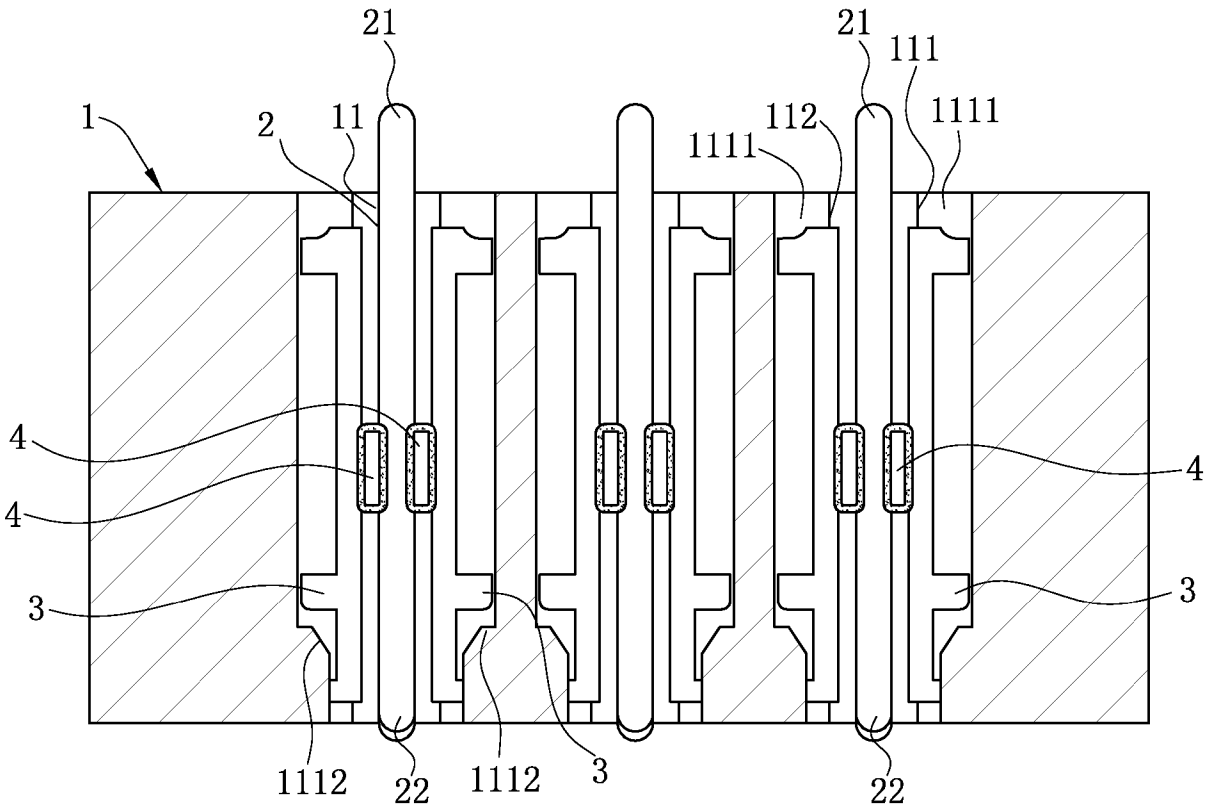
FIG. 8 is a schematic lateral sectional view of the electrical connector shown in FIG. 7.
Figure 9:
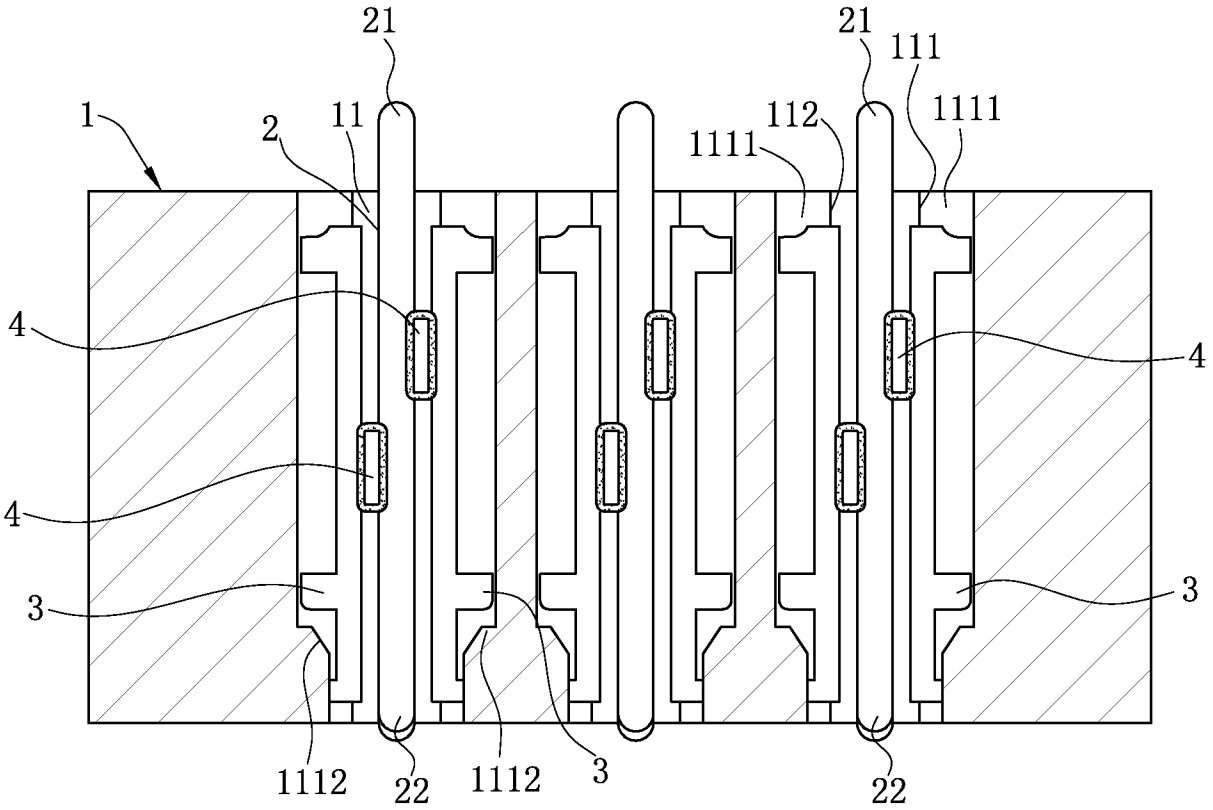
FIG. 9 is a schematic lateral sectional view of the electrical connector according to one embodiment of the present invention.

FIGS. 7-9 show the second embodiment of the present invention. The only difference between a second embodiment and the first embodiment lies in that, there are two fixing pieces 3. The two fixing pieces 3 are located at two opposite sides of the conducting terminal 2, and the second inner wall 112 is the same as the first inner wall 111 as described above. The first inner wall 111 and the second inner wall 112 are disposed opposite to each other. Two limiting slots 1111 are symmetrically disposed at the first inner wall 111 and the second inner wall 112, and the limiting slots 1111 runs through the insulating body 1 from top to bottom. Each of the limiting slots 1111 is convexly provided with a stopping block 1112, and each stopping block 1112 is limited between the two positioning portions 32 of each of the fixing pieces 3 with a gap. As shown in FIG. 8, the two fixing pieces 3 are connected by the insulation piece 4 to locations at the same height of the conducting terminal 2. In other embodiments, as shown in FIG. 9, in order to prevent stress concentration, the two fixing pieces 3 are connected by the insulation piece 4 to locations at different heights of the conducting terminal 2.

To sum up, the electrical connector 100 according to certain embodiments of the present invention, among other things, has the following beneficial advantages.

(1) The fixing piece 3 and the conducting terminal 2 are connected by the insulation piece 4, and the fixing piece 3 fixes the conducting terminal 2 to the insulating body 1. That is, the conducting terminal 2 and the fixing piece 3 are in an insulation connection, so that the fixing piece 3 does not affect the impedance of the conducting terminal 2. When a high-frequency signal is applied to the conducting terminal 2, high-frequency signal reflection because of the impedance change caused by the fixing piece 3 is prevented, thereby ensuring good high-frequency signal transmission.

(2) The conducting terminal 2 is essentially in a regular straight-plate structure. Because the structure is simple, and the impedance change is small, when the high-frequency signal passes through, reflection of the high-frequency signal is small, which also helpfully ensures good high-frequency performance.

(3) One of the conducting terminals 2 partly overlaps with another fixing piece 3 adjacent to the one conducting terminal from a front view. One of the conducting terminals 2 partly overlaps with another conducting terminal 2 adjacent to the one conducting terminal from a top view. Thus, in a situation in which the installation number of the conducting terminals 2 does not change, the volume of the electrical connector 100 is reduced, thereby facilitating the miniature development trend.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, used for electrically connecting a first electronic element and a second electronic element opposite to each other, and comprising:

an insulating body having a plurality of receiving spaces; and a plurality of conducting terminals, correspondingly accommodated in the receiving spaces, wherein at least one fixing piece is connected to one of the conducting terminals through at least one insulation piece, and the fixing piece fixes the one of the conducting terminals into one of the receiving spaces; and wherein the at least one fixing piece is slightly movable up and down in the one of the receiving spaces such that the at least one insulation piece and the one of the conducting terminals move up and down with the at least one fixing piece, and one part of the one of the conducting terminals is located at one side of the at least one fixing piece, and another part of the one of the conducting terminals is located at the other side of the at least one fixing piece.

2. The electrical connector according to claim 1, wherein the conducting terminals are inclined in the receiving spaces.

3. The electrical connector according to claim 2, wherein an inclination angle of a longitudinal direction of the conducting terminals relative to a bottom surface of the first electronic element is greater than 45 degrees and less than 80 degrees.

4. The electrical connector according to claim 1, wherein the conducting terminals are essentially in a regular structure.

5. The electrical connector according to claim 4, wherein the conducting terminals are essentially in a straight-plate structure.

6. The electrical connector according to claim 1, wherein an angle exists between a longitudinal direction of the fixing piece and the longitudinal direction of the one of the conducting terminals, and one of the conducting terminals partly overlaps with another fixing piece adjacent to the one conducting terminal from a front view.

7. The electrical connector according to claim 1, wherein the fixing piece has a torsion arm connected to the conducting terminal through the insulation piece, and the torsion arm is provided with at least one positioning portion positioned with respect to the receiving space.

8. An electrical connector, comprising:

an insulating body having a plurality of receiving spaces; and a plurality of conducting terminals, correspondingly accommodated in the receiving spaces, wherein at least one fixing piece is connected to one of the conducting terminals through at least one insulation piece, and the fixing piece fixes the one of the conducting terminals into one of the receiving spaces;

wherein the fixing piece has a torsion arm connected to the conducting terminal through the insulation piece, and the torsion arm is provided with at least one positioning portion positioned with respect to the receiving space; and wherein each of the receiving spaces has a first inner wall, the first inner wall is provided with a limiting slot, a stopping block protrudes from a side of the limiting slot, the stopping block is located at a lower side or an upper side of the positioning portion, and the stopping block and the positioning portion are not in close fit between each other so that the fixing piece may be slightly displaced in the limiting slot.

9. The electrical connector according to claim 8, wherein there are two fixing pieces, the two fixing pieces are located at two opposite sides of the conducting terminal, and the fixing pieces are respectively limited at the limiting slots of the receiving space disposed opposite to each other.

10. The electrical connector according to claim 8, wherein a convex portion extends from another side of the torsion arm relative to the positioning portion and is limited at the limiting slot.

11. The electrical connector according to claim 8, wherein the receiving space further comprises a second inner wall disposed opposite to the first inner wall, a convex rib is selectively disposed at the second inner wall or the conducting terminal, and correspondingly, the convex rib selectively urges against the conducting terminal or the second inner wall.

12. The electrical connector according to claim 9, wherein the two fixing pieces are connected at a same height of the conducting terminals.

13. The electrical connector according to claim 9, wherein the two fixing pieces are connected at different heights of the conducting terminals.

14. The electrical connector according to claim 1, wherein the conducting terminals and the fixing pieces are all made of a conducting material.

15. The electrical connector according to claim 1, wherein the insulation piece is elastic.

16. The electrical connector according to claim 1, wherein a surface of the insulation piece is coated with viscose gluing the conducting terminals and the fixing pieces, or the insulation piece is made of viscose.

17. The electrical connector according to claim 1, wherein the receiving spaces located at a same row are in communication with each other.

18. The electrical connector according to claim 1, wherein the fixing piece is made of an insulation material.

19. The electrical connector according to claim 1, wherein the fixing piece is elastic.

20. The electrical connector according to claim 1, wherein the fixing piece and the insulation piece are integrally formed.

* * * * *